US005181877A

United States Patent [19]

Perkitny

[11] Patent Number: 5,181,877

[45] Date of Patent: Jan. 26, 1993

[54] APPARATUS FOR SIMULATING A LICKING MOTION

[75] Inventor: Jerzy Perkitny, Bay Village, Ohio 44140

[73] Assignee: Those Characters From Cleveland, Cleveland, Ohio

[21] Appl. No.: 701,205

[22] Filed: May 16, 1991

[51] Int. Cl.[5] ..... A63H 3/36

[52] U.S. Cl. ..... 446/337; 446/395

[58] Field of Search ..... 446/337, 353, 304, 301, 446/300, 356, 368, 359, 156, 157, 338, 339, 341

[56] References Cited

U.S. PATENT DOCUMENTS 1,486,101 3/1924 Megorden ..... 446/337 X 3,828,469 8/1974 Giroud ..... 446/337

4,224,759 9/1980 Saint-Pierre et al. ..... 446/304 X 4,662,856 5/1987 Getgey et al. ..... 446/337 X

*Primary Examiner*—Mickey Yu

*Attorney, Agent, or Firm*—Calfee, Halter & Griswold

[57] ABSTRACT

An apparatus for simulating a licking motion comprises a tongue disposed within a housing. The tongue is pivotally connected along one end to a main gear wheel and partially extends through an aperture formed in the housing. A motor and gear mechanism engage and rotate the main gear wheel in response to a control assembly. As the main gear wheel rotates, the tongue moves within the aperture at varying angles to simulate a licking motion.

13 Claims, 3 Drawing Sheets

APPARATUS FOR SIMULATING A LICKING MOTION

FIELD OF THE INVENTION

The present invention relates to an apparatus for simulating a licking motion, and specifically relates to a tongue partially extending through an aperture in a housing and adapted to move therein at varying angles to simulate a licking motion.

BACKGROUND OF THE INVENTION

There have been a myriad of toys developed over the years for children of all ages. Toys are constantly changing in response to the whims of an increasingly sophisticated market. Nevertheless, a toys' lifetime can sometimes be extended if the toy captures the imagination of the child.

Over the years, the toy art shows that children have had a continuing interest in toys that are animated. For example, toys have been developed that have moveable body members, such as shown in Megorden, U.S. Pat. No. 1,486,101. The Megorden reference shows an amphibian creature having a moveable mouth and tail. The mouth of the creature is adapted to open and close, while the tail is adapted to move from side to side. A tongue moves inwardly and outwardly within the mouth as the mouth opens and closes. The movement of the tongue, mouth, and tail is controlled by protruding wheels that rotate as the creature is rolled along a support surface.

Similarly, Saint Pierre, et al., U.S. Pat. No. 4,224,759, shows a toy dog having a movable tail, wherein insertion of an object in the dog's mouth engages a lever to operate the tail-moving mechanism.

Consequently, there is a continued interest in the toy art for toys that are life-like and animated. Toys which are life-like and animated can capture a child's imagination. Accordingly, manufacturers are constantly attempting to create animated features in toys that will thrill and entertain children over periods of time.

SUMMARY OF THE INVENTION

The present invention relates to an apparatus for simulating a licking motion which is entertaining for a child. The apparatus includes a tongue partially received within a housing. The tongue is adapted to move at varying angles within the housing to simulate a licking motion. The apparatus is particularly designed to be located within a toy so that the toy appears to have animated features.

The housing of the apparatus encloses a main gear wheel and a battery-operated motor for rotation of the gear wheel. The tongue is pivotally attached along one end to the periphery of the main gear wheel and partially extends through and pivots upon an aperture in the housing.

The angle of the tongue with respect to the housing varies as the main gear wheel rotates. In particular, the angle of the tongue is a function of: i) the location of the tongue along the radius of the gear wheel; ii) the location of the tongue along the circumference of the gear wheel—which is dependent upon the rotation of the gear wheel; and iii) the pivot point of the tongue on the aperture of the housing. The rotational speed of the main gear wheel, and hence the movement of the tongue, can be varied by a control assembly located on the housing. Consequently, upon selected activation of the motor by the control assembly, the main gear wheel rotates and moves the tongue at varying angles within the aperture to simulate a licking motion.

One feature of the present invention is to provide an apparatus that has a tongue which simulates a licking motion and which provides a unique animated effect that is entertaining for a child.

Another feature of the invention is that the apparatus can be located within a toy so that the toy appears to have animated features.

Yet another feature of the invention is that the speed of the licking motion can be selectively controlled to vary the animated effect.

Further features and advantages of the present invention will become further apparent from the following detailed description and the accompanying drawings.

DESCRIPTION OF THE PREFERRED EMBODIMENT

Figure 1:
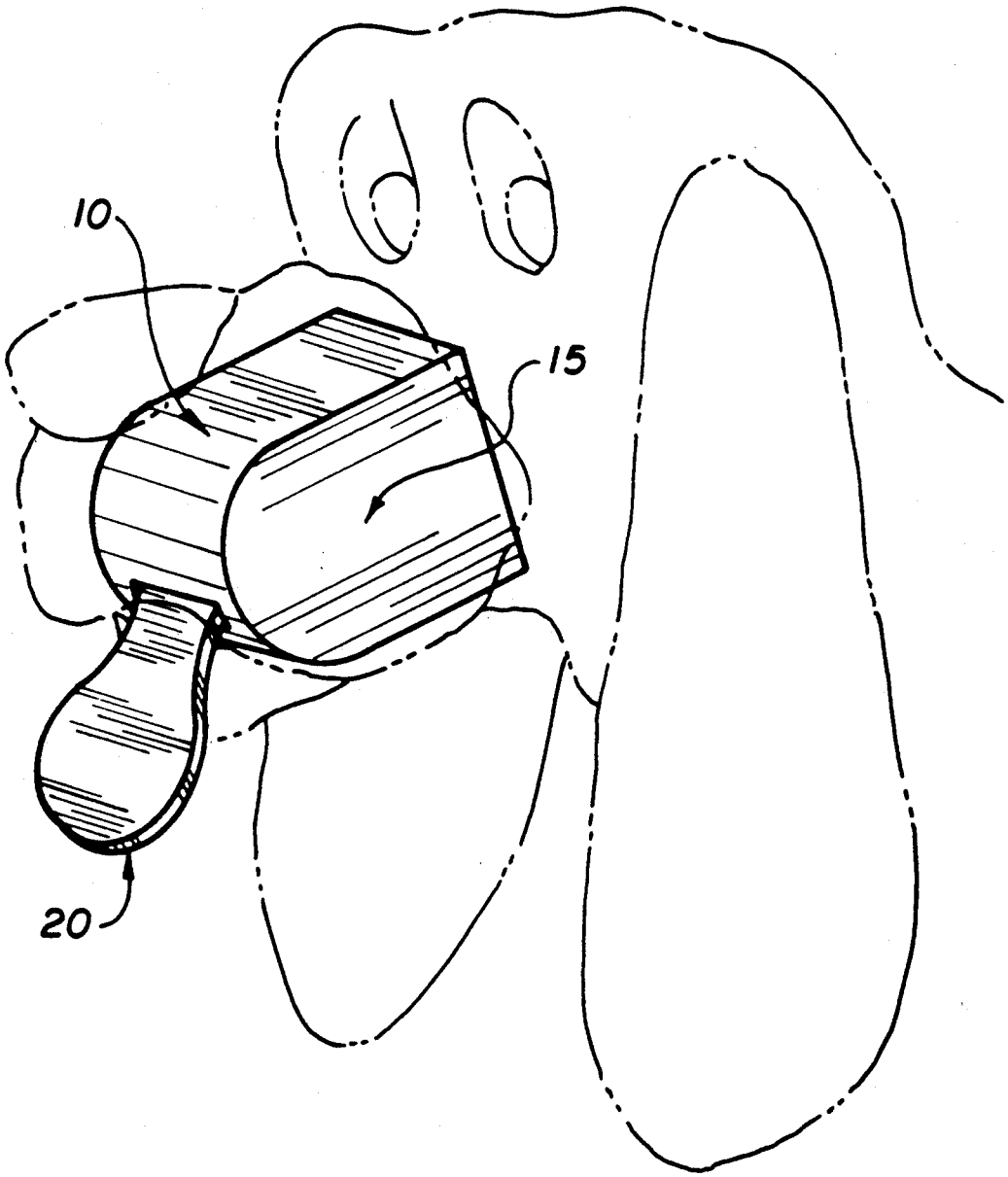
FIG. 1 is a perspective view of the apparatus constructed in accordance with the present invention, illustrating the apparatus located within a toy dog.

FIG. 1 illustrates a licking apparatus, indicated generally at 10, constructed in accordance with the present invention. The licking apparatus 10 includes a housing 15 and a tongue, indicated generally at 20, partially received within the housing 15. The licking mechanism 10 is particularly designed to be incorporate within a toy, e.g., a dog (shown in phantom).

Figure 2:
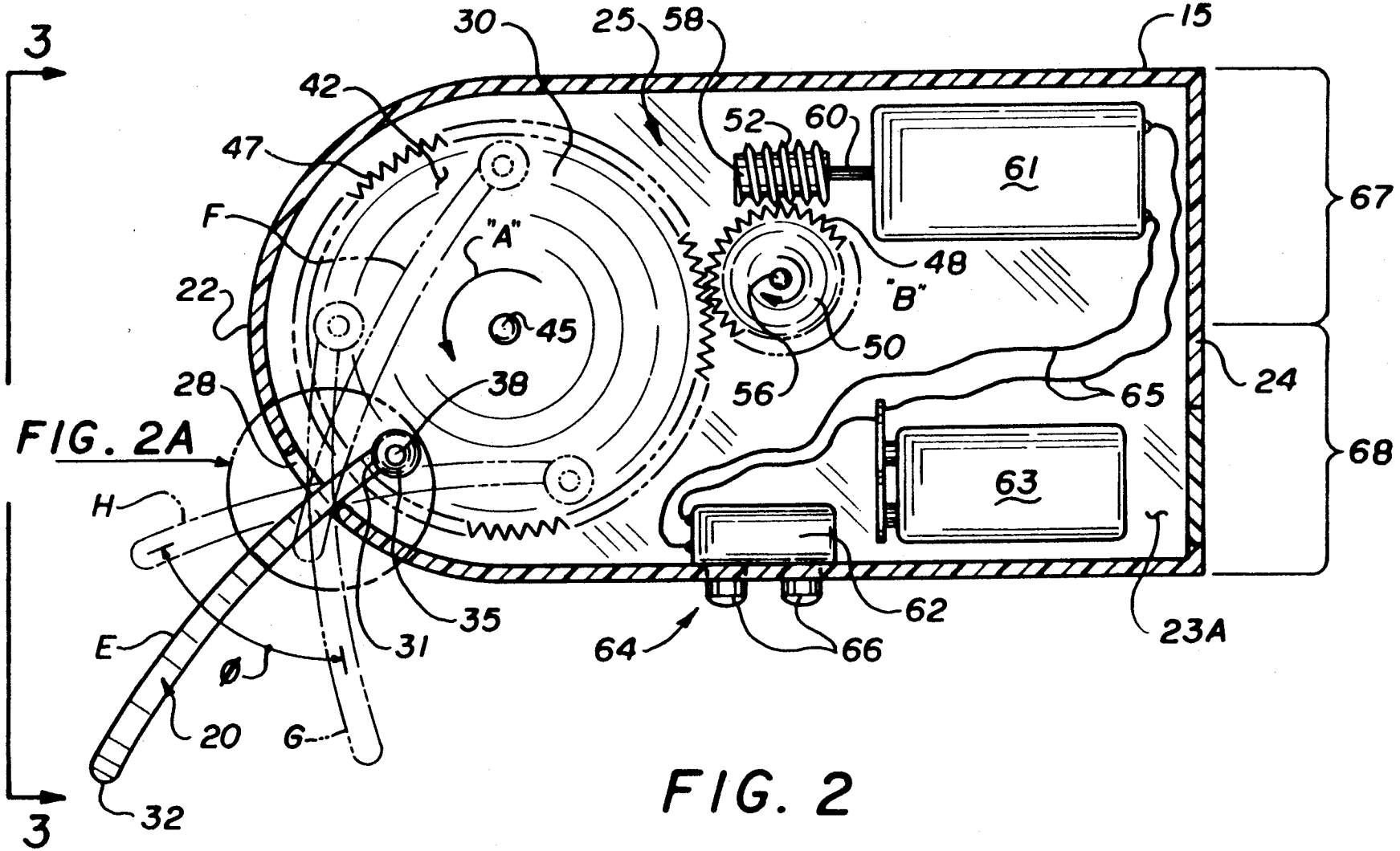
FIG. 2 is a cross-sectional side view of the mechanical components of the apparatus illustrating the tongue in various operational positions.
Figure 3:
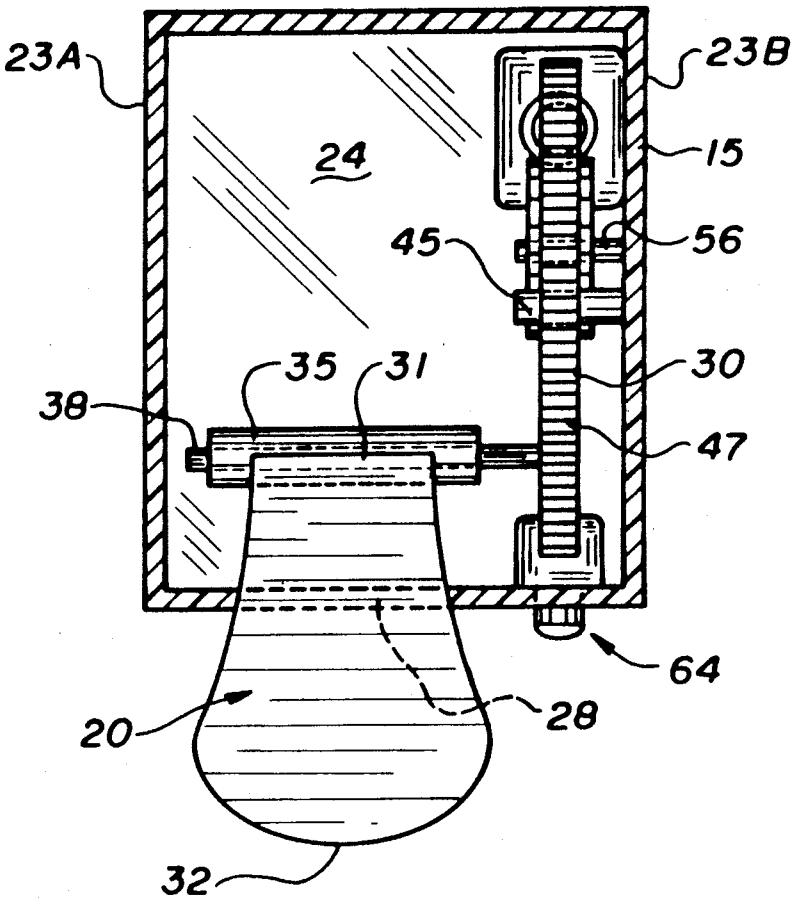
FIG. 3 is a cross-sectional front view of the mechanical components of the apparatus taken substantially along the plane described by the lines 3—3 of FIG. 2.

Referring now to FIGS. 2 and 3, the housing 15 of the apparatus is formed from plastic or other appropriate lightweight material. The housing 15 has a substantially C-shaped portion 22 having sides 23A, 23B and endpiece 24 which form an interior cavity, indicated generally at 25. The C-shaped portion 22 includes an aperture 28 die-cut or otherwise formed therein, as described herein in more detail.

The tongue 20 is pivotally attached along one end near the periphery of a main gear wheel 30. Tongue 20 is formed from a strip of lightweight plastic material or fabric and includes an attached end 31 and a tip 32. The tongue 20 can have a longitudinally curved design that simulates the tongue of an animal, e.g., a dog.

The attached end 31 of tongue 20 is connected to a sleeve 35 which extends widthwise along the end of tongue 20. The sleeve 35 is designed to receive and pivot upon pin 38. Pin 38 is attached by e.g., adhesive, to the inside surface 42 of gear wheel 30 substantially adjacent the periphery, and projects outwardly therefrom at an angle perpendicular to surface 42. Tongue 20 extends from its pivotal attachment on pin 38 through aperture 28 formed in housing 15.

The main gear wheel 30 comprises a disc-shaped member having a centrally formed aperture (unnumbered) which is rotatably mounted on a pin 45. Pin 45 is attached by e.g., adhesive, to side 23B of housing 15.

The main gear wheel 30 has gear teeth 47 which are in mechanical engagement with gear teeth 48 on an adjacent minor gear wheel 50. Minor gear wheel 50 also comprises a disc-shaped member having a centrally-formed aperture (unnumbered) which is rotatably mounted on pin 56. Gear teeth 48 on minor gear wheel 50 are also adapted to mechanically cooperate with gear teeth 52 on an adjacent worm gear 58.

Worm gear 58 is mounted to a drive shaft 60 of a motor 61. Motor 61 is electrically connected between batteries 63 and a control assembly, indicated generally at 64, by wires 65. Motor 61, batteries 63, control assembly 64 and wires 65 comprise an electrical circuit, which can be formed by one of ordinary skill in the art. Control assembly 64 is mounted to the inside surface of housing 15, and includes buttons 66 which extend through apertures (unnumbered) in the housing and which control the voltage applied from batteries 63 to motor 61. The buttons 66 are actuated by the user to vary the speed of rotation of the drive shaft 60 of motor 61, and hence the movement of the main gear wheel 30. The buttons 66 can include, e.g., a slow and a fast speed, or can be a conventional on/off switch which provides constant rotation of the drive shaft 60. Alternatively, the control assembly 64 can be located externally of the housing 15 at different locations within a toy to facilitate activation of the motor.

The motor 61 is adapted to rotate the main gear wheel 30 in a counterclockwise manner, as indicated generally by the arrow "A" in FIG. 2. In particular, the worm gear 58 on drive shaft 60 engages and rotates minor gear wheel 50 in a clockwise manner, as indicated by the arrow "B" in FIG. 2; which in turn engages and rotates main gear wheel 30 in a counterclockwise manner. Such a counterclockwise manner, as described more fully herein, is adapted to create the impression that the tongue 20 is simulating a "licking" motion.

The housing 15 is bisected into a top half 67 and a bottom half 68. The aperture 28 in the C-shaped portion 22 is preferably formed in the bottom half 68 of the housing 15. The aperture 28 includes parallel top and bottom edges 71, 72, as shown most clearly in FIG. 2A. The width and length of the aperture 28 are such that the tongue 20 can move inward and outward between the top and bottom edges without becoming stuck. Moreover, referring to FIGS. 2 and 3, since the main gear wheel 30 is mounted adjacent and in parallel relationship to side 23B of housing 15, and since tongue 20 is pivotally connected on pin 50 substantially perpendicular to main gear 30, then tongue 20 extends through aperture 28 in parallel relation to top edge 71 and bottom edge 72.

The operation of the apparatus is as follows. Upon actuation of the control assembly 64, motor 61 causes drive shaft 60 to rotate, which in turn causes minor gear wheel 50 to rotate in a clockwise direction; and main gear wheel 30 to rotate in a counterclockwise direction. As the main gear wheel 30 rotates, the connection of tongue 20 to main gear wheel 30 along sleeve 35 alternatingly rotates toward and away from aperture 28 in housing 15.

In particular, as the sleeve rotates toward aperture 28, as illustrated at E in FIG. 2, the tongue 20 is urged out of housing 15. At the point where sleeve 35 is substantially adjacent aperture 28, the tongue 20 is forced out of housing 15 to its maximum extent. As the sleeve rotates past aperture 28, the tongue is drawn into housing 15, until at a point directly opposite aperture 28, as illustrated at F in FIG. 2, the tongue 20 is drawn into the housing to its maximum extent.

During rotation of the main gear wheel 30, the angle $\phi$ through which the tongue 20 moves is dictated by (i) the location of the tongue along the radius of the main gear wheel; ii) the location of the tongue's connection along the circumference of the gear wheel—which is dependent upon the rotation of the gear wheel; and iii) the pivot point of the tongue on the aperture of the housing.

Figure 2A:
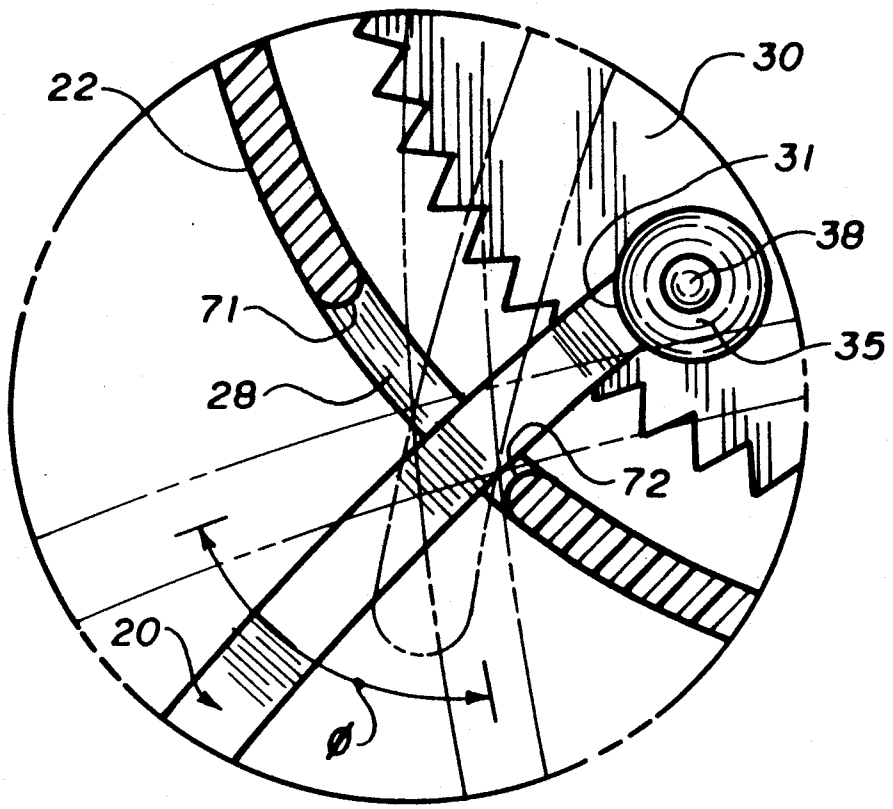
FIG. 2A is an enlarged cross-sectional side view of the tongue in FIG. 2 in various operational positions.

In particular, as shown in more detail in FIG. 2A, the tongue 20 extends from its connection with the main gear wheel and preferably rests on the bottom edge 72 of the aperture 28. It is possible, however, that the tongue may rest on the upper edge 71 of the aperture 28 during rotation of the main gear wheel, particularly when the assembly is supported at different angles, when the assembly is inverted, or when the motor is operating at high speeds. In any case, the upper edge 71 of the aperture 28 will force the tongue to respond in much the same way as the bottom edge 72, as described herein in more detail.

As the main gear wheel 30 rotates, the angle $\phi$ through which the tongue moves, and the length of tongue extending through the aperture, is constantly changing. In particular, the location of the tongue along the circumference of the wheel varies in the horizontal and vertical directions as the main gear wheel 30 rotates. Additionally, the length of the tongue extending through the aperture varies as the sleeve rotates toward and away from the aperture 28. Accordingly, the location of the tongue's pivot point on the aperture varies as the main gear wheel rotates, which along with the location of the tongue's connection on the rotating gear wheel, determines the angle at which the tongue extends through the aperture.

Moreover, the connection of the tongue with the main gear wheel is preferably located proximate the periphery of the main gear wheel. When the connection is located in this manner, there is significant horizontal and vertical movement of the tongue as the main gear wheel rotates, which thereby simulates a "licking motion". Accordingly, the main gear wheel 30 should have an appropriate diameter—which is determined by both the proposed length of the tongue and the dimensions of the housing. The diameter must be chosen such that when the tongue is resting on an edge of the aperture, significant horizontal and vertical movement of the tongue occurs during rotation of the main gear wheel.

For example, when the tongue's connection with the main gear wheel is at an orientation substantially above and vertically aligned with the bottom edge 72 of the aperture, the tongue hangs vertically downward through the aperture. At this point, the tongue is at a maximum angle $\phi$ of approximately 90°, as can be seen generally at G in FIG. 2. As the main gear wheel continues to rotate, the tongue is drawn into the housing and pivots on bottom edge 72 until the tongue is horizontally aligned with the bottom edge 72 of the aperture. At this point, the tongue is at a minimum angle $\phi$ of approximately 0°, as is shown generally at H in FIG. 2.

As the main gear wheel continues to rotate, the tongue's connection with the main gear wheel alternatingly rotates from an orientation substantially vertical to the bottom side of the aperture to a position that is substantially horizontal to, or even below, the bottom edge of the aperture. Moreover, the length of the tongue extending from the housing varies as the sleeve rotates toward and away from the aperture. The portion of the tongue extending through the aperture 28 pivots upward and inwardly into the housing; and then downwardly and out of the housing, which thereby simulates a "licking motion".

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled n the art without departing from the spirit of the present invention. Accordingly, the foregoing detailed description should be considered exemplary in nature and not as limiting to the scope and spirit of the invention set forth in the appended claims.

I claim:

1. An apparatus for simulating the licking motion of a tongue comprising:

a housing having a wall with an opening formed therein, a rotatable member disposed within the housing, means for rotating the rotatable member in a single direction, a tongue-shaped member pivotally connected at a pivot axis toward the periphery of said rotatable member and extending partially through the opening in the wall, the rotatable member moving said tongue-shaped member relative to the opening in the wall as said rotatable member rotates, said tongue-shaped member adapted to engage an edge of the opening in the wall as the rotatable member rotates to cause predetermined pivotal movement of said tongue-shaped member and predetermined movement of said tongue-shaped member relative to the opening in the wall to simulate a licking motion such that at one point during the rotation of said rotatable member, the pivot axis is substantially vertically aligned with respect to the opening in said wall, while at another point during the rotation of said rotatable member, the pivot axis is substantially horizontally aligned with respect to the opening in said wall.

2. An apparatus as defined in claim 1, wherein said tongue-shaped member is adapted to pivot from a minimum angle to a maximum angle, the difference between said minimum and maximum angles being approximately 90°.

3. An apparatus as in claim 2, wherein said tongue-shaped member is adapted to move relative to the opening in the wall such that at one point in the rotation of the rotatable member, substantially the whole tongue-shaped member is drawn outside of said housing, and that at another point in the rotation of the rotatable member, substantially the whole tongue-shaped member is drawn inside said housing.

4. An apparatus as defined in claim 3, wherein the tongue-shaped member includes a tip and an attachment end, the tip being located outside of said housing and moveable relative to said housing as said rotatable member rotates, and said attachment end being pivotally connected toward the periphery of said rotatable member.

5. An apparatus as in claim 4, wherein said attachment end alternately moves from a position substantially adjacent said opening in said wall to a position spaced distant from said opening as said rotatable member rotates.

6. An apparatus as defined in claim 5, further including a control means for varying the speed of rotation of said rotatable member.

7. An apparatus as defined in claim 6, wherein said control means influences the rotatable member to rotate at least two different speeds.

8. An apparatus as defined in claim 7, wherein said tongue-shaped member has a longitudinally curved shape.

9. An apparatus as defined in claim 8, wherein said housing is disposed within an inner cavity of a toy.

10. An apparatus comprising:

a body having a head with an internal cavity, said head having external facial components and an opening through which a tongue-shaped member at least partially extends, a rotatable member disposed within the cavity, means for rotating the rotatable member in a single direction, said tongue-shaped member being pivotally connected at a pivot axis toward the periphery of the rotatable member, the rotatable member moving said tongue-shaped member relative to the opening in the head as the rotatable member rotates, said tongue-shaped member adapted to engage an edge of the opening in the head as the rotatable member rotates to cause predetermined pivotal movement of said tongue-shaped member and predetermined movement of said tongue-shaped member relative to the opening in the head to simulate a licking motion such that at one point during the rotation of said rotatable member, the pivot axis is substantially vertically aligned with respect to the opening in said head, while at another point during the rotation of said rotatable member, the pivot axis is substantially horizontally aligned with respect to the opening in said head.

11. An apparatus as defined in claim 10, wherein said tongue-shaped member is pivotally connected toward the periphery of a main gear wheel mounted within a housing, said main gear wheel being rotatably engaged by a minor gear wheel also mounted within said housing, and said minor gear wheel being rotatably engaged by a screw gear mounted on a drive shaft of a battery-operated motor, said battery-operated motor having a control assembly to control the activation and deactivation of the motor.

12. An apparatus comprising:

a toy animal body having a head with an internal cavity, said head having a simulated mouth with an opening, a housing disposed within said internal cavity of said body, said housing also having an opening, a rotatable member disposed within and enclosed by said housing, a tongue-shaped member pivotally attached at a pivot axis to said rotatable member and at least partially extending through the opening in said housing and the opening in said head, a device for rotating the rotatable member, the rotatable member moving the pivot axis of said tongue-shaped member relative to the opening in the head and the opening in the housing as the rotatable member rotates to simulate a licking motion such that at one point during the rotation of said rotatable member, the pivot axis is substantially vertically aligned with respect to the opening in said housing, while at another point during the rotation of said rotatable member, the pivot axis is substantially horizontally aligned with respect to the opening in said housing.

13. An apparatus as in claim 12, wherein said tongue shaped member pivotally engages an edge surrounding the opening in said housing as said rotatable member rotates, such that when said pivot axis is at said one point, said tongue shaped member forms a first angle with said opening, and when said pivot axis is at said another point, said tongue shaped member forms a second angle with respect to said opening, the difference between said first angle and said second angle being approximately 90 degrees.

* * * * *